US006789281B2

(12) United States Patent
Wilson

(10) Patent No.: US 6,789,281 B2
(45) Date of Patent: Sep. 14, 2004

(54) CERVICAL SPINE REHABILITATION SYSTEM

(75) Inventor: Allan S. Wilson, Mission Viejo, CA (US)

(73) Assignee: Anabolic Laboratories, Inc., Lake Forest, CA (US)

( * ) Notice: Subject to any disclaimer, the term of this patent is extended or adjusted under 35 U.S.C. 154(b) by 0 days.

(21) Appl. No.: 10/270,744

(22) Filed: Oct. 11, 2002

(65) Prior Publication Data

US 2004/0068799 A1 Apr. 15, 2004

(51) Int. Cl.[7] ..... A47C 20/00
(52) U.S. Cl. ..... 5/632; 5/633; 5/640; 5/657
(58) Field of Search ..... 5/636, 637, 648, 5/695, 630, 632, 633, 634, 657; 128/845

(56) References Cited

U.S. PATENT DOCUMENTS 4,218,792 A * 8/1980 Kogan ..... 5/636
4,856,886 A * 8/1989 Polzer et al. ..... 359/875
5,088,141 A * 2/1992 Meyer et al. ..... 5/636
5,279,310 A * 1/1994 Hsien ..... 5/632
5,824,013 A * 10/1998 Allen ..... 606/240
5,987,675 A * 11/1999 Kim ..... 5/632
6,292,964 B1 * 9/2001 Rose et al. ..... 5/630

* cited by examiner

*Primary Examiner*—Michael F. Trettel
(74) *Attorney, Agent, or Firm*—Knobbe, Martens, Olson & Bear, LLP

(57) ABSTRACT

A system for restoring the natural lordosis of the cervical spine is provided. The system comprises at least a base pillow having areas of varying thickness, and including a protuberance. A central portion of the base pillow preferably includes a depression for receiving a patient's head. A thicker edge portion provides support for the patient's neck, while the protuberance provides support for the patients thoracic vertebrae. A second pillow is positionable adjacent the base pillow to provide further elevation for the patient's head. The system may include yet another pillow having a size greater than the second pillow to provide still further elevation for the patient's head. The system may also include additional pillows having shapes smaller than, larger than, or in between the size of the other pillows. A method of using the pillows to treat a cervical spinal disorder is also provided.

9 Claims, 7 Drawing Sheets

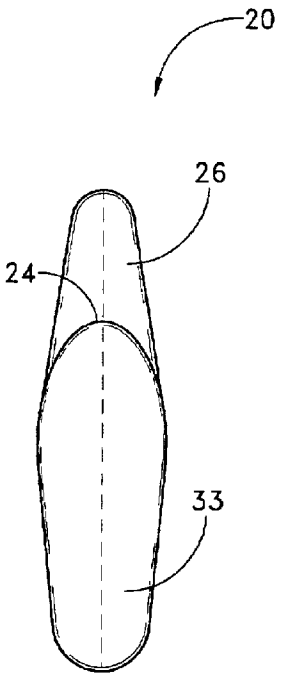
FIG. 4
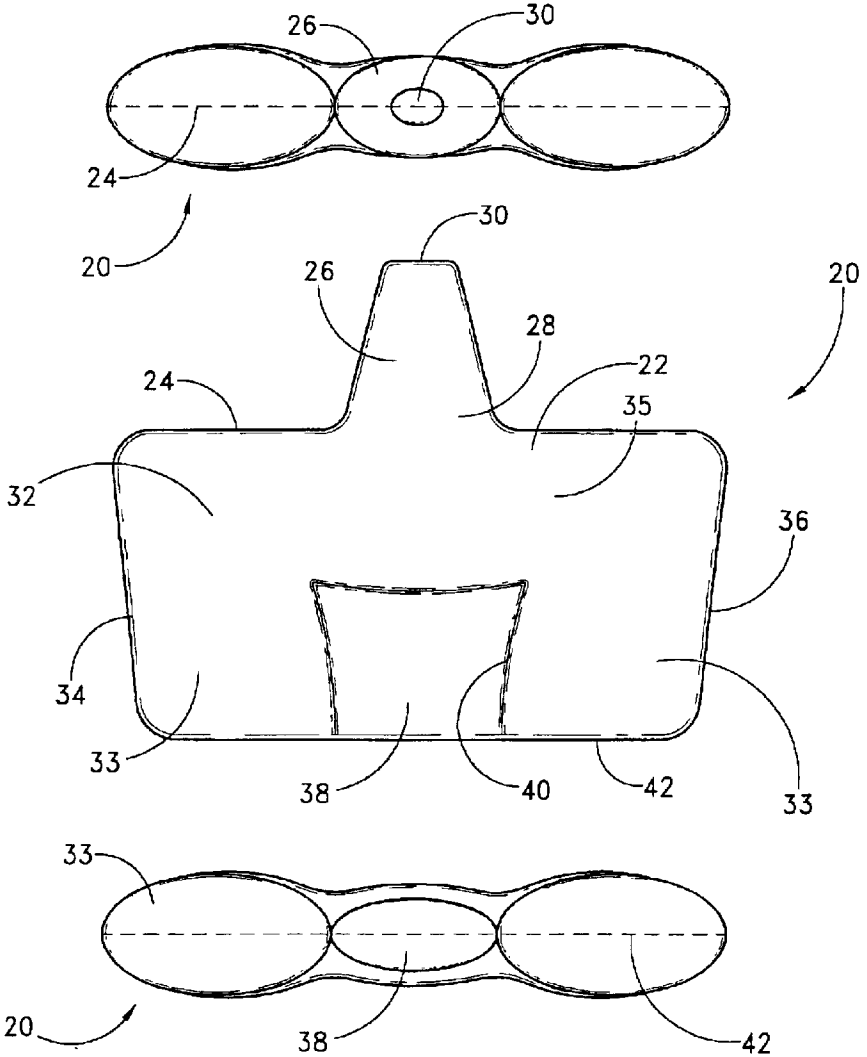

CERVICAL SPINE REHABILITATION SYSTEM

BACKGROUND OF THE INVENTION

1. Field of the Invention

The present invention relates to devices for treating spinal injuries. More specifically, the present invention provides an apparatus for rehabilitation of cervical acceleration/deceleration syndrome.

2. Description of the Related Art

The neck, or cervical spinal region, of the human body has a natural curvature or lordosis. This curvature is generally concave toward the posterior side of the body. A number of injuries, such as cervical acceleration/deceleration syndrome, or "whiplash," may cause this curvature to flatten out, or to curve in the opposite direction. Such a cervical spine curvature disorder can be quite painful for the patient, especially where it causes a blockage of the spinal cord opening, resulting in pinched nerves. If the disorder is not corrected, it can result in spinal degeneration, further adding to the patient's discomfort. This condition can also cause moderate to severe distortion of nerve function. Such distortion may cause limbs, particularly arms and hands, to swell, and may degrade the patient's ability to use such limbs.

A number of rehabilitation methods are commonly used to treat cervical spine curvature disorders. One such method employs a specially shaped pillow that the patient uses each night when he or she retires. The pillow supports the head and neck in such a way that normal cervical curvature is gradually restored. Often, the pillow is used in combination with other rehabilitation methods.

The pillow typically has areas of varying thickness. An example of such a pillow is disclosed in U.S. Pat. No. 5,708,998. This pillow includes a central depression surrounded by thicker rolls. First and second neck-supporting rolls have two different diameters to provide comfortable support to patients having two different neck sizes. To use the pillow, the patient lies on his or her back with his or her head in the central depression and a neck roll supporting the cervical spinal region. The patient's head is thus only slightly elevated, while the neck is firmly supported. This position helps to restore natural cervical lordosis.

This pillow, and others like it, can be uncomfortable to use. The minimal head elevation provided by the pillow, coupled with firm neck support, can put too much pressure on the cervical spinal region. The pressure essentially urges the cervical spine back toward its normal curvature too quickly, leading to patient discomfort. Often, when a patient finds that a course of therapy is causing more pain than it is relieving, the patient will discontinue the rehabilitation therapy. Of course, discontinuing any course of therapy can have detrimental effects. In the case of spinal curvature restoration therapy, the patient's spine may never return to its normal shape, and the patient may suffer discomfort for the rest of his or her life.

Thus, a device that gradually restores cervical lordosis without causing patient discomfort would be a significant advance in the field of spinal rehabilitation therapy.

SUMMARY OF THE INVENTION

The preferred embodiments of the cervical spine rehabilitation system have several features, no single one of which is solely responsible for their desirable attributes.

Without limiting the scope of this cervical spine rehabilitation system as expressed by the claims that follow, its more prominent features will now be discussed briefly. After considering this discussion, and particularly after reading the section entitled "Detailed Description of the Preferred Embodiments," one will understand how the features of the preferred embodiments provide advantages, which include comfortable and rehabilitative neck support for sufferers of cervical spinal lordosis disorders, and progressive therapy that avoids over-extending the patient's spine in the early stages of recovery.

A preferred embodiment of the cervical spine rehabilitation system comprises a first pillow having a first region that is generally U-shaped, including a pair of legs and a span. The first pillow further comprises a second region, defining an area partially bounded by the legs and span of the first region, and a third region protruding from an outer edge of the span and tapering inwardly in a direction away from the outer edge. A thickness of the first region is greater than a thickness of the second region.

Another preferred embodiment of the cervical spine rehabilitation system further comprises a second pillow. The second pillow is substantially cylindrical and has a diameter D.

Another preferred embodiment of the cervical spine rehabilitation system further comprises a third pillow. The third pillow is substantially cylindrical and has a diameter d that is less than the diameter D.

Another preferred embodiment of the cervical spine rehabilitation system comprises a method of treating a cervical lordosis disorder. The method comprises the steps of positioning a first pillow upon a flat surface, the first pillow having a first region that is generally U-shaped and includes a pair of legs and a span, a second region defining an area partially bounded by the legs and span of the first region, and a third region protruding from an outer edge of the span and tapering inwardly in a direction away from the outer edge, and wherein a thickness of a portion of the first region is greater than a thickness of a portion of the second region; positioning a second pillow atop the first pillow such that end portions of the second pillow rest atop the legs of the first pillow, wherein the second pillow is substantially cylindrical and has a diameter D; and positioning a patient upon the pillows such that his or her head is supported by the second pillow, his or her shoulders are supported by the span, and his or her thoracic vertebrae are supported by the third region.

Another preferred embodiment of the cervical spine rehabilitation system further comprises the step of replacing the second pillow with a third pillow, wherein the third pillow is substantially cylindrical and has a diameter d which is less than D, and the step of positioning a patient upon the pillows such that his or her head is supported by the third pillow, his or her shoulders are supported by the span, and his or her thoracic vertebrae are supported by the third region.

Another preferred embodiment of the cervical spine rehabilitation system further comprises the step of removing the third pillow, and positioning a patient upon the first pillow such that his or her head is supported by the second region, his or her neck and shoulders are supported by the span, and his or her thoracic vertebrae are supported by the third region.

Another preferred embodiment of the cervical spine rehabilitation system comprises a method of treating a cervical lordosis disorder. The method comprises the steps of positioning a pillow upon a flat surface, the pillow having a first region, a second region defining an area partially bounded by the first region, and a third region protruding from the first region; and positioning a patient upon the pillow such that his or her head is supported by the second region, his or her neck and shoulders are supported by the first region, and his or her thoracic vertebrae are supported by the third region.

BRIEF DESCRIPTION OF THE DRAWINGS

The preferred embodiments of the cervical spine rehabilitation device, illustrating its features, will now be discussed in detail. These embodiments depict the novel and non-obvious cervical spine rehabilitation device shown in the accompanying drawings, which are for illustrative purposes only. These drawings include the following figures, in which like numerals indicate like parts:

FIG. 4 is a top plan view, front elevational view, rear elevational view and right-side elevational view of the base pillow of FIG. 1;

DETAILED DESCRIPTION OF THE PREFERRED EMBODIMENTS

Figure 1:
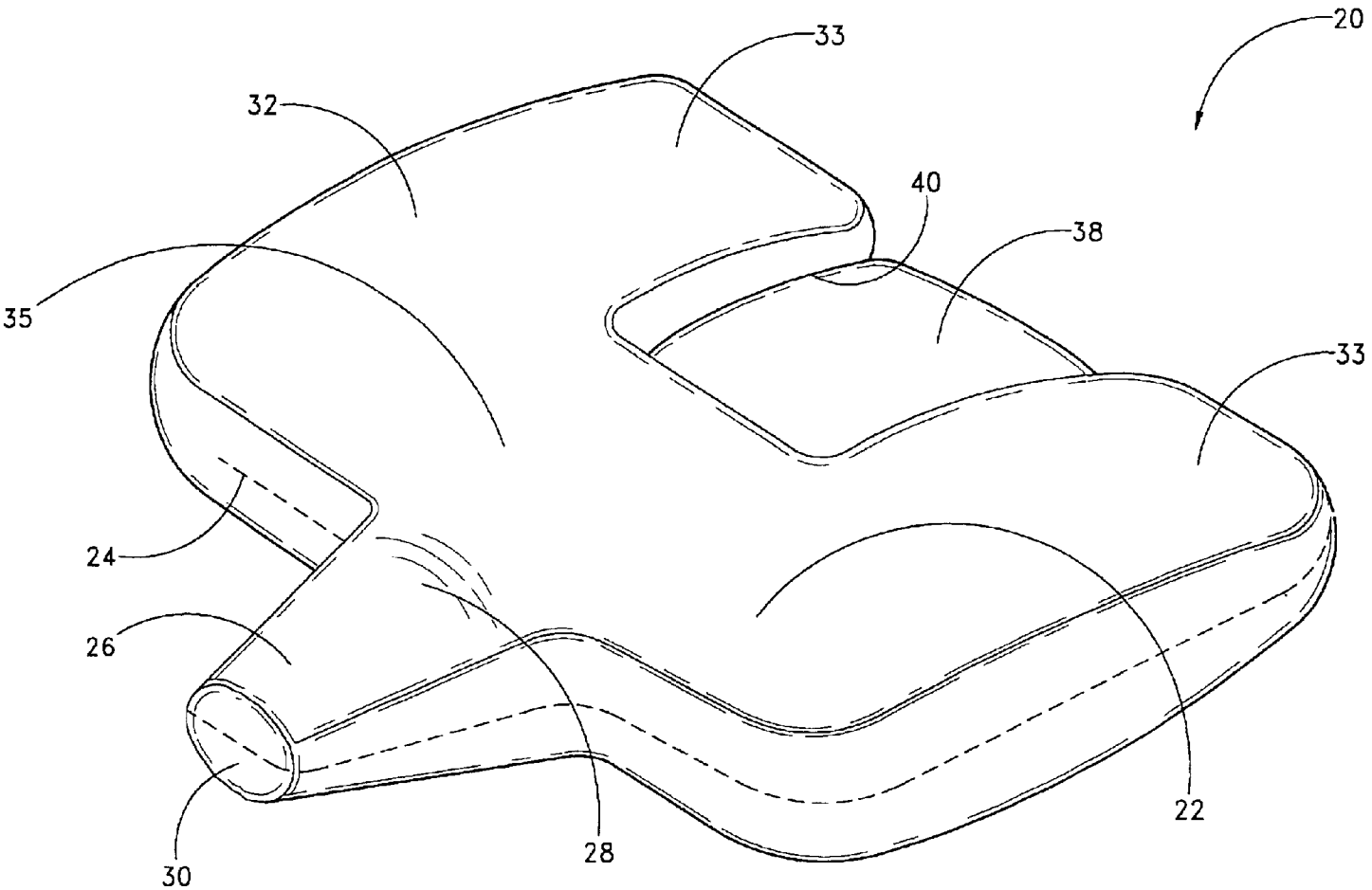
FIG. 1 is a perspective view of a base pillow of the system according to the present invention.
Figure 2:
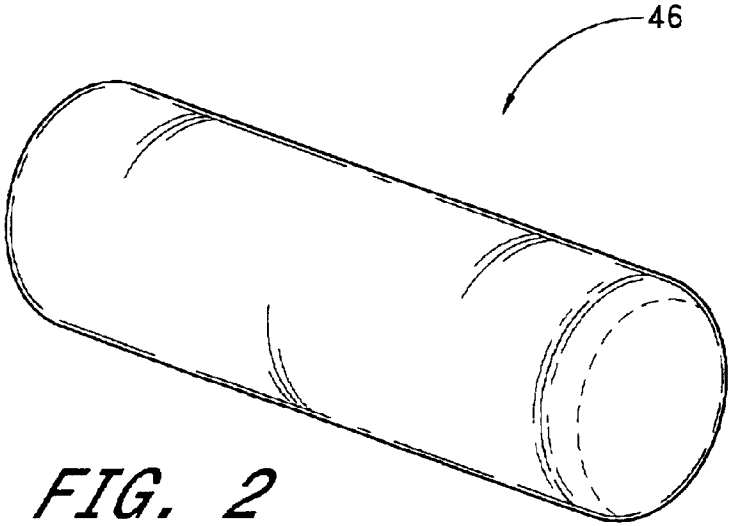
FIG. 2 is a perspective view of a large elevation pillow of the system according to the present invention.

The cervical spine rehabilitation system, pictured in FIGS. 1–6, comprises at least a first, or base pillow 20. The base pillow 20 is preferably constructed of a soft, cushioning, resilient filler material contained within a cloth shell. A preferred material for the filler is polyester. A preferred material for the shell is a polyester-cotton blend.

The base pillow 20 comprises a head and neck support portion 22 that is substantially trapezoidal in plan aspect, as shown in FIG. 4. A lower edge 24 of the base pillow 20 is the longer of two parallel sides that comprise the head and neck support portion 22. A center of the lower edge 24 includes a protuberance 26, which comprises a thoracic spine support portion. The protuberance 26 is substantially coplanar with the head and neck support portion 22 of the pillow, and is also substantially trapezoidal in plan aspect, tapering inwardly in a direction away from the head and neck support portion 22. A base portion 28 of the protuberance 26, which borders the head and neck support portion 22, is approximately one-fourth the length of the lower edge 24 of the head and neck support portion 22. The shorter parallel side 30 of the protuberance 26 is approximately half as long as the base portion 28.

Referring to FIG. 4, the head and neck support portion 22 of the base pillow 20 includes a first region 32 that is substantially U-shaped in plan aspect, including a pair of legs 33 and a base 35. The first region 32 defines two edges 34, 36 and the lower edge 24 of the head and neck support portion 22. The edges 34, 36 may be non-parallel as shown or parallel. The head and neck support portion 22 of the base pillow 20 also includes a second region 38, that is four-sided in plan aspect and is surrounded on three sides by the first region 32. The first region 32 and second region 38 are separated by a stitched boundary 40, where the base pillow 20 includes little or no filler material.

The thickness of the first region 32 preferably tapers slightly from a maximum thickness near the lower edge 24, to a minimum thickness at the upper edge 42. The second region 38 has a maximum thickness at its center, and tapers to a minimum thickness at its edges. The second region 38 is preferably considerably thinner than the first region 32. The thickest portion of the first region 32 is preferably slightly more than twice the thickness of the thickest portion of the second region 38. The thickness of the protuberance 26 tapers from a maximum thickness at its base 28, to a minimum thickness at its terminus 30 that is approximately half the maximum thickness.

One of skill in the art will appreciate that the illustrated relative thicknesses of the base pillow 20 are merely exemplary. For example, the regions of the pillow 20 may be constructed using other geometric shapes known to those of skill in the art. A multitude of other relative thicknesses are within the scope of the base pillow 20. Preferably, however, a portion of the first region 32 near the lower edge 24 is substantially thicker than the second region 38.

Figure 3:
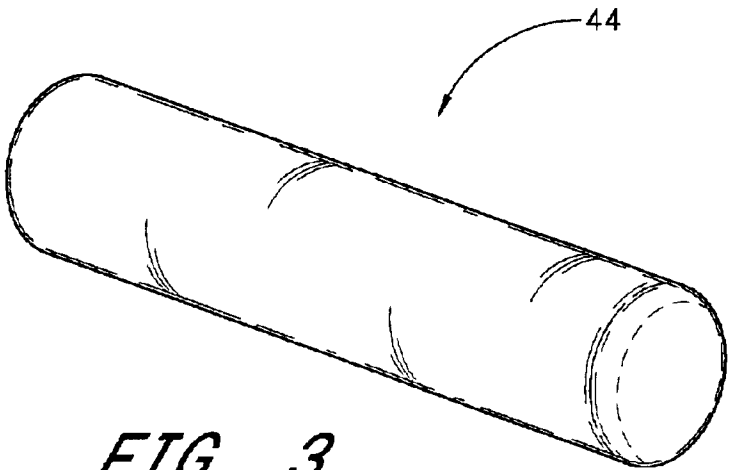
FIG. 3 is a perspective view of a small elevation pillow of the system according to the present invention.
Figure 5:
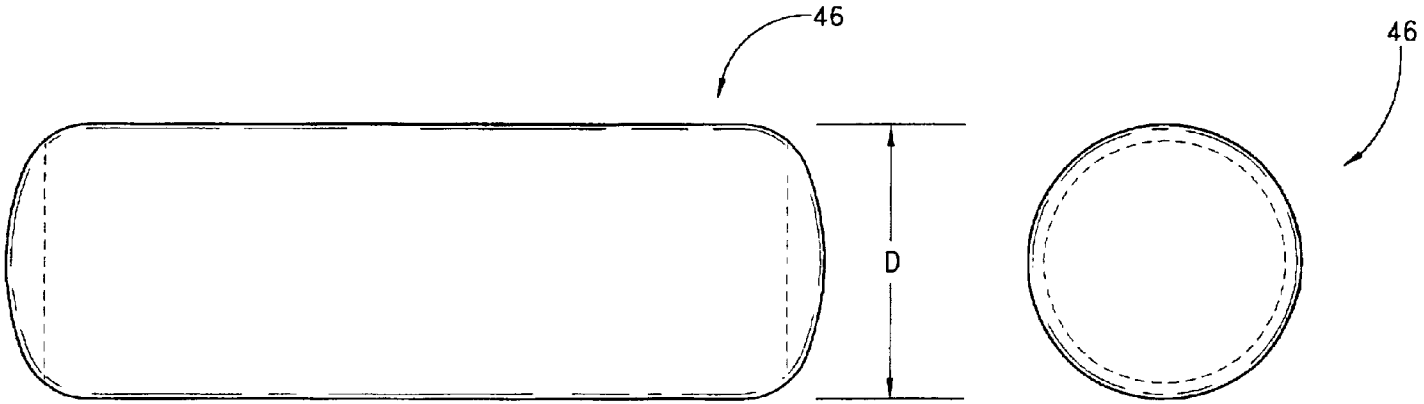
FIG. 5 is a top plan view and right-side elevational view of the pillow of FIG. 2.
Figure 6:
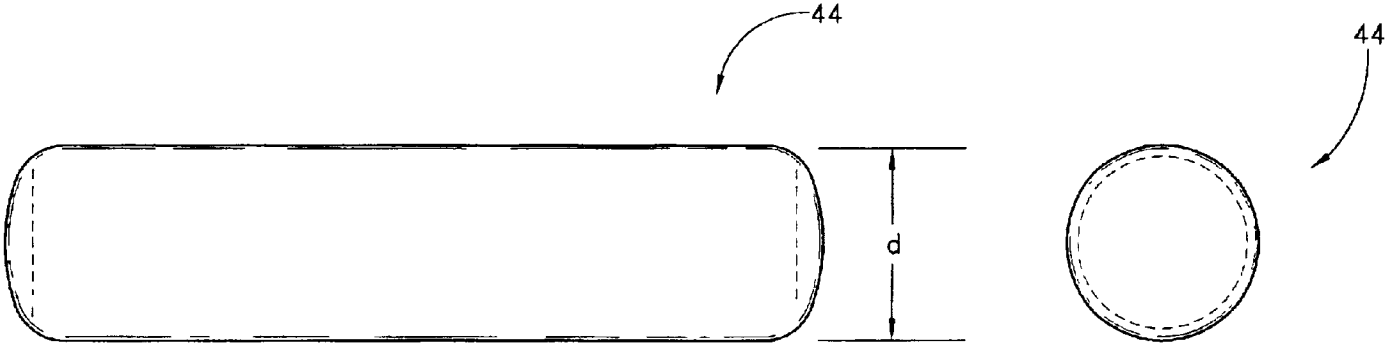
FIG. 6 is a top plan view and right-side elevational view of the pillow of FIG. 3.

The system preferably comprises at least a second pillow, or small elevation pillow 44, illustrated in FIGS. 3 and 6. The small elevation pillow 44 is substantially cylindrical, having a diameter d. Either end of the cylinder may be planer or slightly concave or convex. A length of the small elevation pillow 44 is preferably substantially the same as the length of the upper edge 42 of the head and neck support portion 22 of the base pillow 20.

The system preferably also comprises a third pillow, or large elevation pillow 46. The large elevation pillow 46 has a diameter D, that is larger than the diameter d of the small elevation pillow 44. In one preferred embodiment, the diameter D is about 7/5 the diameter d. In all other respects, the large elevation pillow 46 is preferably substantially identical to the small elevation pillow 44. Of course, the pillows 44, 46 may be of any desired cross section or shape and each may employ a different shape.

Figure 7:
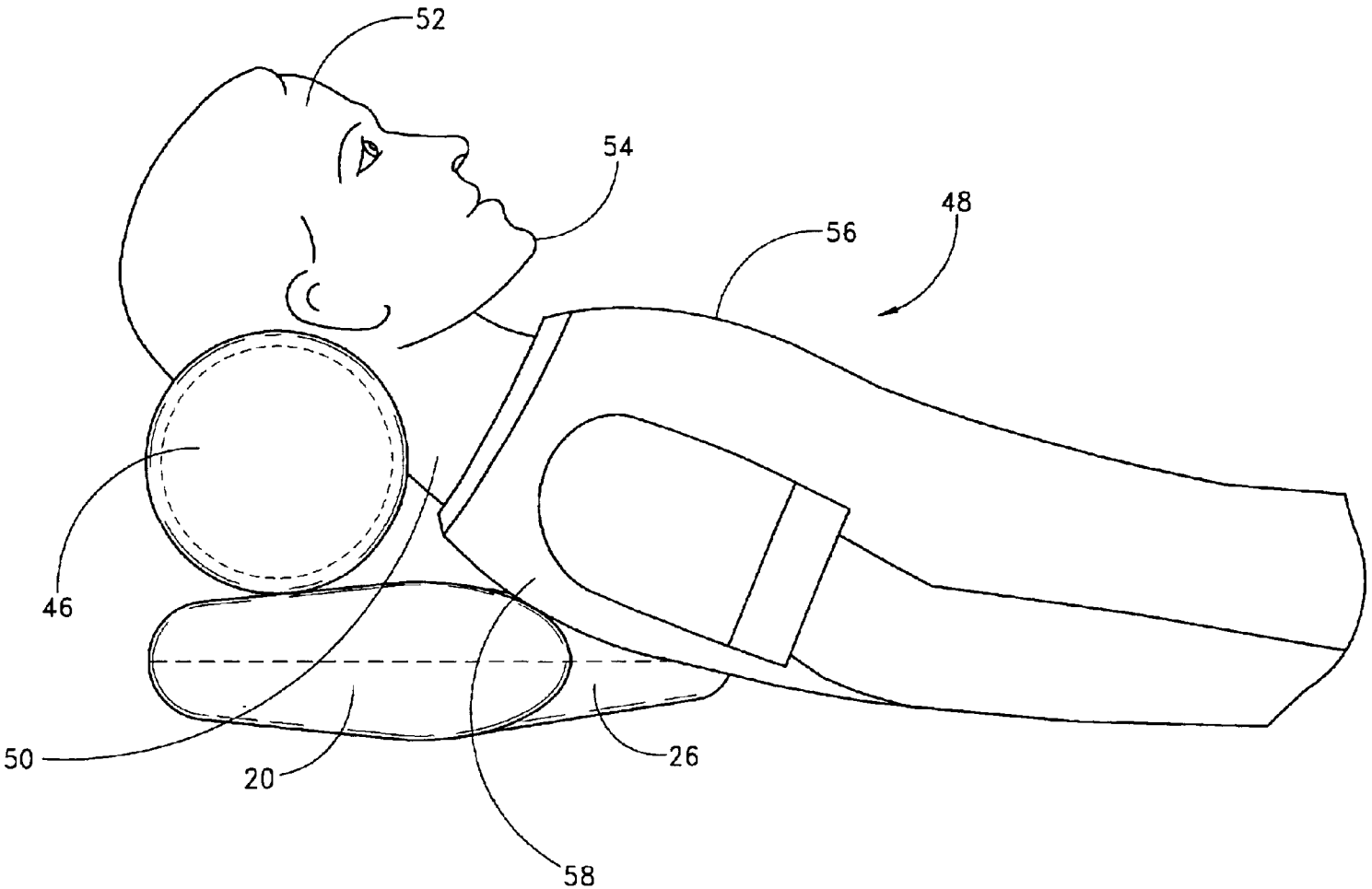
FIG. 7 is a side view of a patient using a preferred embodiment of the pillow system of FIGS. 1–3.
Figure 8:
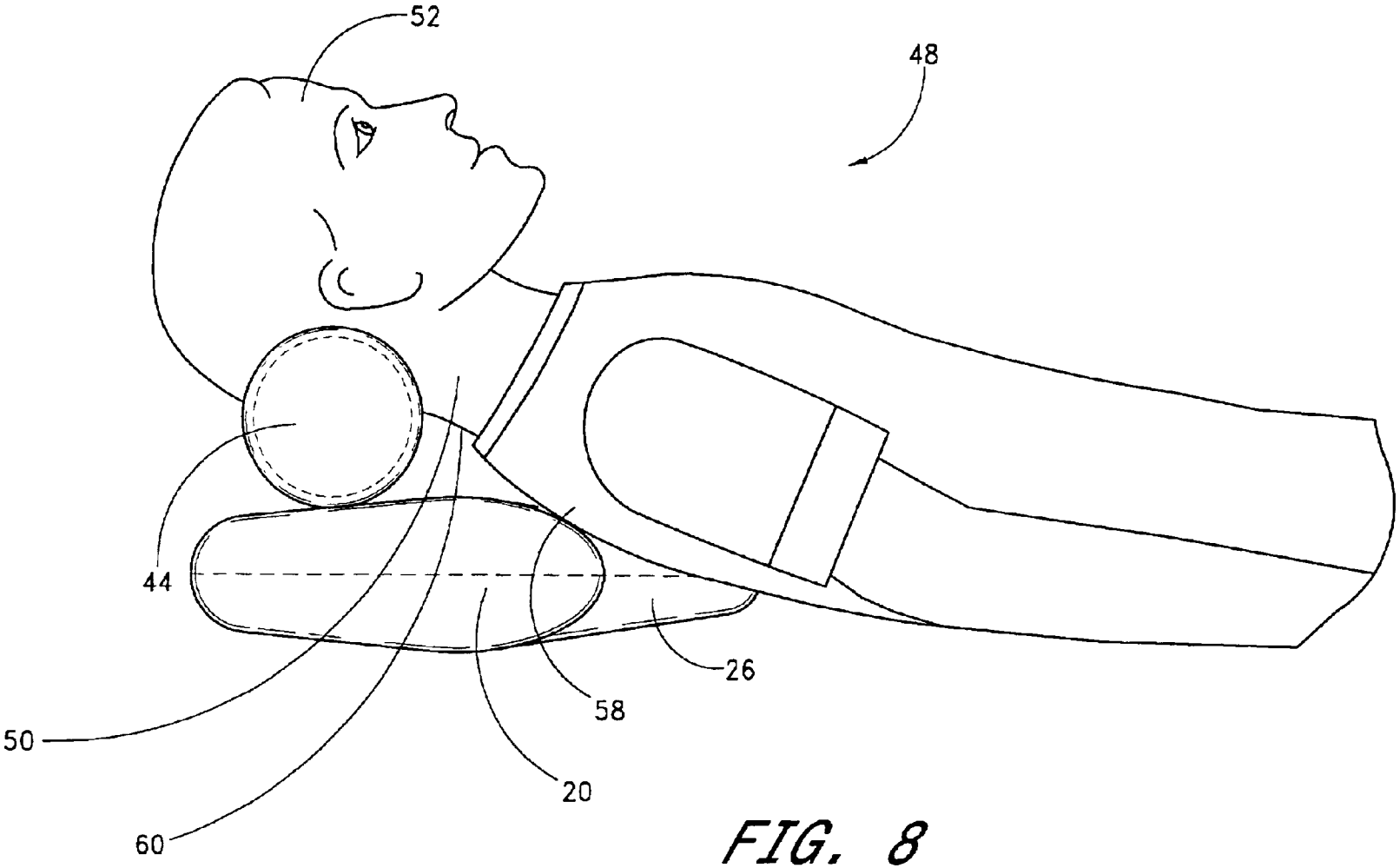
FIG. 8 is a side view of a patient using another preferred embodiment of the pillow system of FIGS. 1–3.
Figure 9:
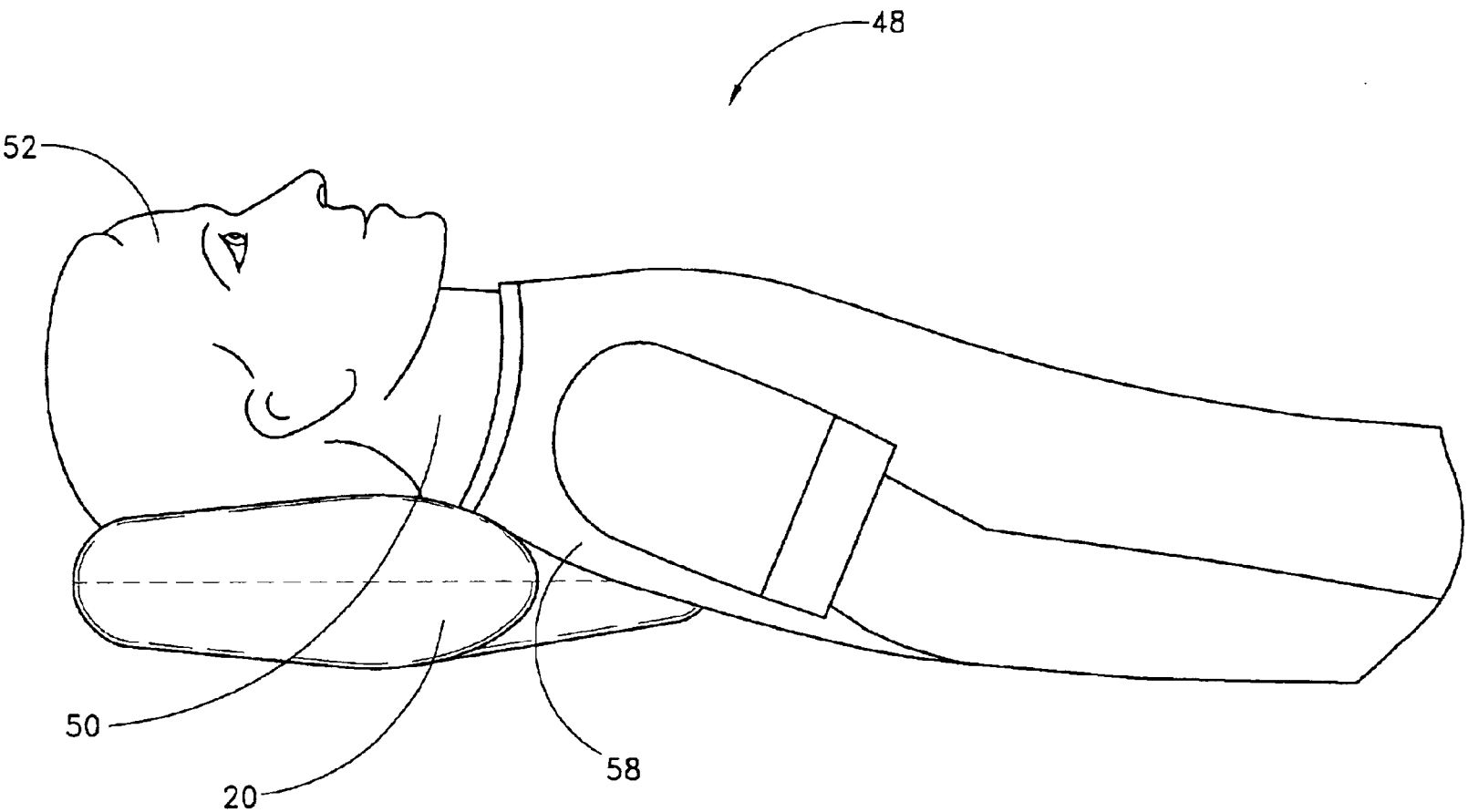
FIG. 9 is a side view of a patient using another preferred embodiment of the pillow system of FIGS. 1–3.

FIGS. 7–9 illustrate a method of using a preferred embodiment of the cervical spine rehabilitation system. The patient 48 in FIG. 7 is in an early stage of rehabilitation. Thus, he has little or no lordosis in the cervical region 50 of his spine. At this early stage, the patient 48 is most comfortable with his head 52 elevated such that his chin 54 is pushed toward his chest 56.

To situate himself in the position of FIG. 7, the patient 48 places the base pillow 20 on a flat surface, such as a bed, where he will lie for an extended period. He then positions the large elevation pillow 46 atop the base pillow 20 such that a longitudinal axis of the large elevation pillow 46 is parallel to the lower edge 24 of the base pillow 20, and the ends of the large elevation pillow 46 are supported by the legs 33 of the first region 32 of the base pillow 20.

The patient 48 then lies in a supine position with his head 52 supported by the large elevation pillow 46, his shoulders 58 supported by the base 35 of the first region 32 of the base pillow 20, and his thoracic vertebrae (not visible) supported by the protuberance 26 of the base pillow 20. In this position, the patient's head 52 is elevated such that his neck does not contact the base pillow 20. Due to the lack of lordosis in the patient's cervical spine 50, this position is most comfortable for the patient 48 because no pressure is applied to the posterior side of his neck.

The protuberance 26 provides needed support for the patient's thoracic vertebrae. The thoracic region of the human back has a natural curvature in a direction transverse to the body. Thus, when a patient lies on his or her back, his or her shoulder blades rest upon the surface on which the patient is lying, but his or her thoracic vertebrae are elevated. Lying in such a position places stresses upon the patient's spine. The protuberance 26 removes these stresses by providing support for the central region of the patient's back. The protuberance 26 thus further increases the patient's comfort and speeds his or her recovery.

As the patient's therapy progresses, the lordosis gradually returns to his cervical spine 50. A patient in such an intermediate stage of rehabilitation is most comfortable having his head elevated, but not elevated to such an extent as in the early stage described above. Therefore, a patient in an intermediate rehabilitation stage would not prefer to use the pillow configuration of FIG. 7. Instead, the patient would prefer to replace the large elevation pillow 46 with a small elevation pillow 44. FIG. 8 illustrates this pillow configuration.

The patient 48 of FIG. 8 is in an intermediate stage of rehabilitation. Thus, his cervical spine 50 has regained some lordosis, but has not yet returned to its normal state. Therefore, the patient 48 positions the small elevation pillow 44 atop the base pillow 20 in the same fashion as he previously positioned the large elevation pillow 46. He lies in a supine position with his head 52 supported by the small elevation pillow 44, his shoulders 58 supported by the base 35 of the first region 32 of the base pillow 20, and his thoracic vertebrae supported by the protuberance 26 of the base pillow 20. Because the patient's head 52 is less elevated than in the early stage of rehabilitation, the slight curvature in his cervical spine 50 is better supported in the position of FIG. 8. Although the posterior portion 60 of the patient's neck may not actually touch the base pillow 20, the relative orientation of his head 52 and shoulders 58 provides greater comfort to the patient 48 and encourages further lordosis recovery.

The patient 48 in FIG. 9 is in a late stage of rehabilitation. Thus, his cervical spine 50 has regained a substantial portion of its former curvature. At this stage, the patient 48 is most comfortable with his head 52 only slightly elevated above his shoulders 58, and firm support beneath the posterior portion of his neck. Therefore, the patient 48 positions the base pillow 20 upon a flat surface without either of the elevation pillows 44, 46. He lies in a supine position with his head 52 supported by the second region 38 of the base pillow 20, his neck supported by the base 35 of the first region 32 of the base pillow 20, and his thoracic vertebrae supported by the protuberance 26 of the base pillow 20.

In the position depicted in FIG. 9, the patient's head 52 is tilted back slightly with respect to his shoulders 58, and the base 35 of the first region 32 of the base pillow 20 provides firm support for the patient's neck. The existing curvature in the patient's cervical spine 50 is thus well supported, and the patient's spine is urged to curve even further.

An advantage of the cervical spine rehabilitation system is its modularity. As a patient progresses through therapy, he or she can select which pillows to use according to which position is most comfortable. One of skill in the art will appreciate that the system may include further elevation pillows having diameters less than, greater than, or intermediate to d and D. The system may, for example, include four elevation pillows, such that a patient progresses through five separate stages of rehabilitation with five different pillow configurations.

One of skill in the art will also appreciate that not all human bodies are built the same, and that not all spinal lordosis disorders are the same. For example, females often have shorter necks than males. Thus, a female in an early stage of recovery may achieve sufficient head elevation, and be most comfortable, using the base pillow 20 by itself. Also, a minor whiplash injury may decrease lordosis without completely eliminating it. Therefore, a patient in an early stage of recovery from a mild case of whiplash may also be most comfortable with only the base pillow 20.

Further, the pillow system may be provided with means for attaching one pillow to another to maintain their relative position. For example, snaps or hook-and-loop fastener may be used to secure the pillows together. Alternatively, the force of gravity and the weight of a user's head may maintain the pillows in their proper position.

In another method of using the system of the present invention, the second and/or third pillows 44, 46, would be placed underneath the first pillow 20 to achieve the desired level of lordosis as opposed to on top of first pillow 20. As will be understood by those of skill in the art, appropriately sized pillow cases may be provided for each of the pillows to maintain the cleanliness of the pillows. Alternatively, the pillows described herein may be manufactured of washable materials.

Scope of the Invention

The above presents a description of the best mode contemplated for the present cervical spine rehabilitation system, and of the manner and process of making and using it, in such full, clear, concise, and exact terms as to enable any person skilled in the art to which it pertains to make and use this cervical spine rehabilitation system. This cervical spine rehabilitation system is, however, susceptible to modifications and alternate constructions from that discussed above which are fully equivalent. Consequently, it is not the intention to limit this cervical spine rehabilitation system to the particular embodiments disclosed. On the contrary, the intention is to cover all modifications and alternate constructions coming within the spirit and scope of the cervical spine rehabilitation system as generally expressed by the following claims, which particularly point out and distinctly claim the subject matter of the cervical spine rehabilitation system.

What is claimed is:

1. A cervical spine rehabilitation system, comprising:

a first pillow, the first pillow having a first region that is generally U-shaped, including a pair of legs and a span, a second region defining an area partially bounded by the legs and span of the first region, and a third region protruding from an outer edge of the span, the third region having a maximum width along a border with the span outer edge and tapering inwardly in a direction away from the outer edge, wherein a thickness of a portion of the first region is greater than a thickness of a portion of the second region.

2. The cervical spine rehabilitation system of claim 1, further comprising:

a second pillow, the second pillow being substantially cylindrical and having a diameter D.

3. The cervical spine rehabilitation system of claim 2, further comprising:

a third pillow, the third pillow being substantially cylindrical and having a diameter d that is less than the diameter D.

4. The cervical spine rehabilitation system of claim 1, wherein the first pillow comprises:

two pieces of cloth having substantially identical shapes; and a soft resilient filler material; wherein the pieces are sewn to one another about edges thereof and the filler material occupies the space therebetween.

5. The cervical spine rehabilitation system of claim 4, wherein a border between the first and second regions comprises stitching.

6. A method of treating a cervical lordosis disorder, the method comprising the steps of:

positioning a first pillow upon a flat surface, the first pillow having a first region, including a pair of legs and a span, a second region defining an area partially bounded by the first region, and a third region protruding from the first region;

positioning a second pillow with respect to the first pillow such that end portions of the second pillow contact the first region of the first pillow, wherein the second pillow is substantially cylindrical and has a diameter D; and positioning a patient upon the pillows such that his or her head is supported by the second pillow, his or her shoulders are supported by the first region, and his or her thoracic vertebrae are supported by the third region.

7. The method of claim 6, further comprising the step of:

replacing the second pillow with a third pillow, wherein the third pillow is substantially cylindrical and has a diameter d which is less than D; and positioning a patient upon the first and third pillows such that his or her head is supported by the third pillow, his or her shoulders are supported by the first region, and his or her thoracic vertebrae are supported by the third region.

8. The method of claim 7, further comprising the step of:

removing the third pillow; and positioning a patient upon the first pillow such that his or her head is supported by the second region, his or her neck and shoulders are supported by the first region, and his or her thoracic vertebrae are supported by the third region.

9. A method of treating a cervical lordosis disorder, the method comprising the steps of:

positioning a pillow upon a flat surface, the pillow having a first region that is generally U-shaped and includes a pair of legs and a span, a second region defining an area partially bounded by the legs and span of the first region, and a third region protruding from an outer edge of the span, the third region having a maximum width along a border with the span outer edge and tapering inwardly in a direction away from the outer edge; and positioning a patient upon the pillow such that his or her head is supported by the second region, his or her neck and shoulders are supported by the span, and his or her thoracic vertebrae are supported by the third region.

* * * * *